US008408926B1

(12) United States Patent
Chang

(10) Patent No.: US 8,408,926 B1
(45) Date of Patent: Apr. 2, 2013

(54) NETWORK CONNECTOR WITH SWITCH FUNCTION

(76) Inventor: Nai-Chien Chang, Linkou Township, Taipei County (TW)

( * ) Notice: Subject to any disclaimer, the term of this patent is extended or adjusted under 35 U.S.C. 154(b) by 3 days.

(21) Appl. No.: 12/957,453

(22) Filed: Dec. 1, 2010

(51) Int. Cl.
*H01R 29/00* (2006.01)

(52) U.S. Cl. ..... 439/188

(58) Field of Classification Search ..... 439/188, 439/49, 668, 489–490, 607.02, 620.22
See application file for complete search history.

(56) References Cited

U.S. PATENT DOCUMENTS 4,612,519 A * 9/1986 Gargini et al. ..... 333/103
5,233,501 A * 8/1993 Allen et al. ..... 361/733
7,207,819 B2 * 4/2007 Chen ..... 439/188
7,241,157 B2 * 7/2007 Zhuang et al. ..... 439/188
7,371,981 B2 * 5/2008 Abdul-Hafiz ..... 200/51 R
7,473,115 B2 * 1/2009 Yu et al. ..... 439/188
7,524,211 B2 * 4/2009 Norris et al. ..... 439/668
7,811,137 B2 * 10/2010 Chang ..... 439/676
7,896,672 B2 * 3/2011 Felisilda De La Cruz .... 439/188
7,968,810 B2 * 6/2011 Follingstad et al. ..... 200/51 R
2009/0233473 A1 * 9/2009 Wang ..... 439/188

* cited by examiner

*Primary Examiner* — Chandrika Prasad
(74) *Attorney, Agent, or Firm* — Chun-Ming Shih; HDLS IPR Services

(57) ABSTRACT

The network connector of the invention includes an isolated body, a switch module, an input pin set and an output pin set. The switch module includes a circuit board and switch component thereon. The input pin set and output pin set electrically connect to the switch component. When the network connector receives external electricity, the switch component will be electrically opened or closed to turn on or off the network connection.

15 Claims, 7 Drawing Sheets

NETWORK CONNECTOR WITH SWITCH FUNCTION

BACKGROUND OF THE INVENTION

1. Technical Field

The invention relates to connectors, particularly to network connectors.

2. Related Art

With the progressiveness of technologies and development of semiconductor industries, computers have become a necessary device. Similarly, almost all computers are provided with network connection ability. That is, network connection is indispensable for computers.

Most computers employ an RJ-45 connector to make a simple wired network connection. No doubt, RJ-45 is the mainstream of network connection.

Generally speaking, there are three ways to disconnect a network connection of a computer:

1. Remove a network cord from a network connector of the computer;
2. Operate software of the computer to disconnect; and
3. Use a firewall of the server connecting the computer to interrupt network connection.

However, the previous two ways must set hardware or software of the computer, so they are suitable for computer users. For a network administrator, it is so inconvenient because it cannot be remotely operated. The latter way involves complicated software configuration of the server. All those computers connecting to the server will be disconnected once this configuration has an error. So it is disadvantageous for an inexperienced network administrator.

For network administrators, there is a need to simply turn on or off network connection.

SUMMARY OF THE INVENTION

An object of the invention is to provide a network connector with switch function, which can turn on or off network connection by external electricity.

To accomplish the above object, the network connector of the invention includes an isolated body, a switch module, an input pin set and an output pin set. The switch module includes a circuit board and switch component thereon. The input pin set and output pin set electrically connect to the switch component. When the network connector receives external electricity, the switch component will be electrically opened or closed to turn on or off the network connection.

The invention can control the network connector to be turned on or off by external electricity, so that the network connection can be made or interrupted. A network administrator may remotely control network connection of a plurality of computers. Thus the network administration can be more efficient.

DETAILED DESCRIPTION OF THE INVENTION

Figure 1:
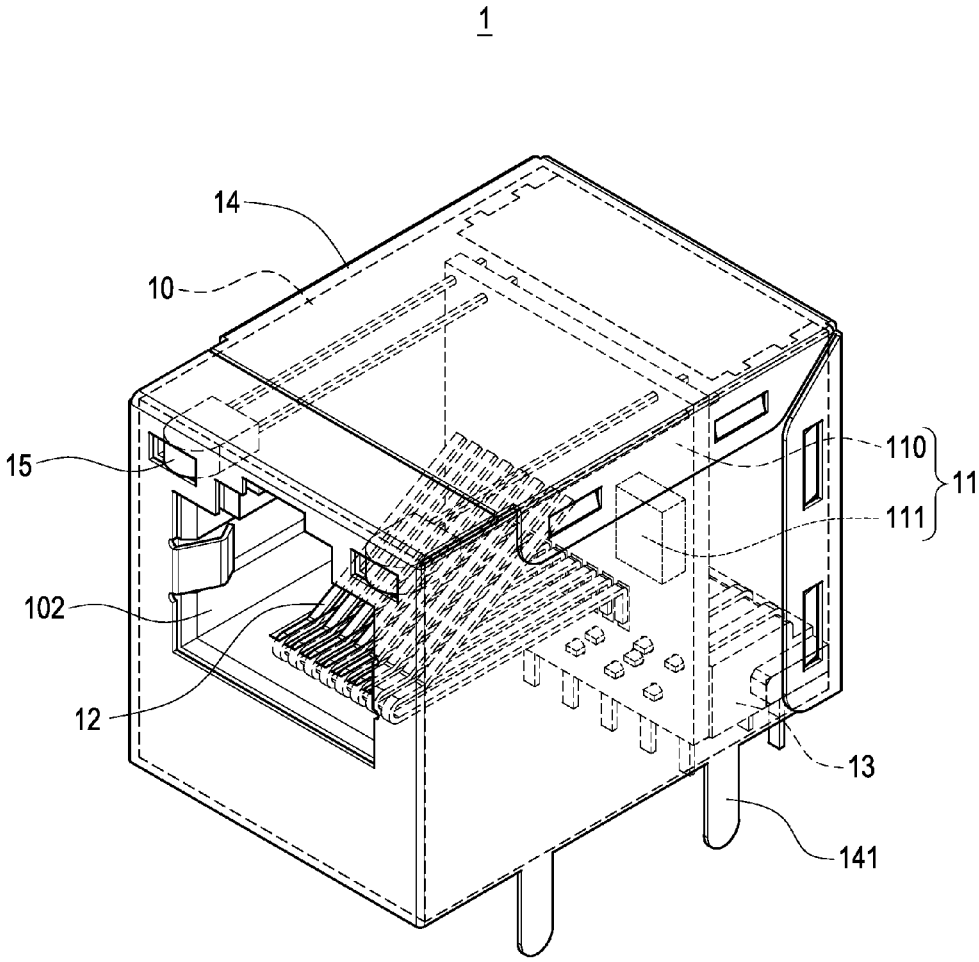
FIG. 1 is a perspective view of a preferred embodiment of the invention.
Figure 2:
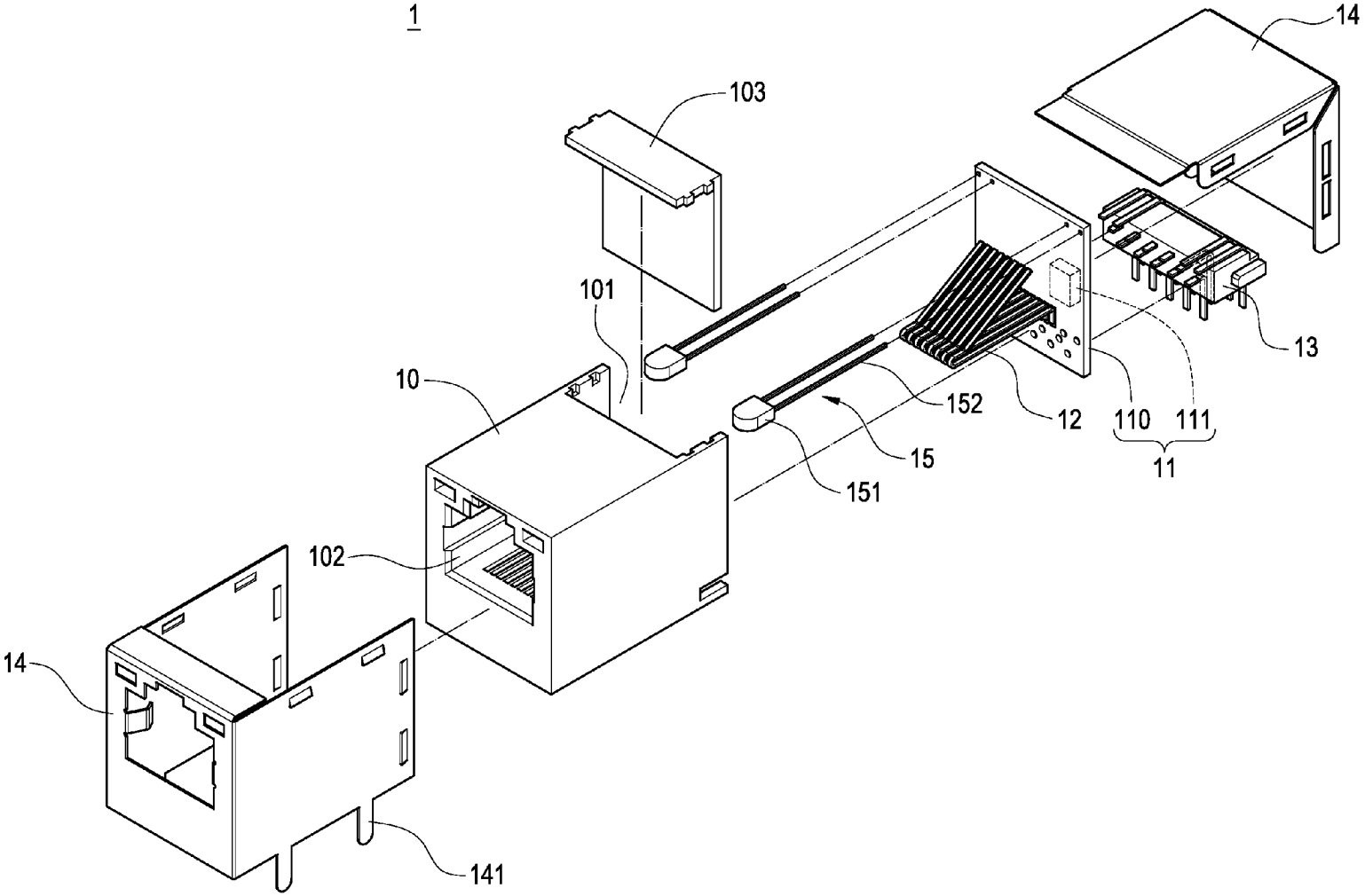
FIG. 2 is an exploded view of a preferred embodiment of the invention.
Figure 3:
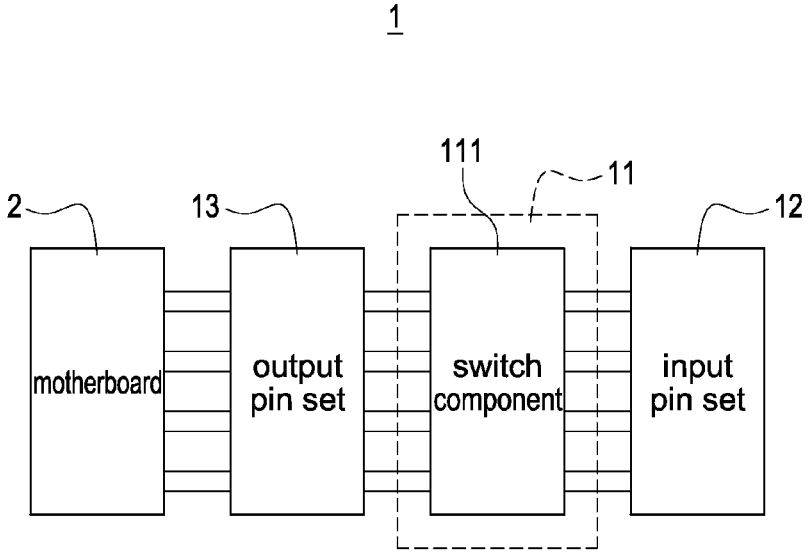
FIG. 3 is a block diagram of a preferred embodiment of the invention.

FIGS. 1-3 are a perspective view, an exploded view and a block diagram of a preferred embodiment of the invention, respectively. The network connector of the invention includes an isolated body 10, a switch module 11, an input pin set 12, an output pin set 13 and a metal case 14. The case 14 covers the isolated body 10 to provide a function of electromagnetic shielding.

There is a room 101 in the isolated body 10 for accommodating the switch module 11, the input pin set 12 and the output pin set 13. A through trough 102 communicating with the room 101 is disposed at one side of the isolated body 10. The switch module 11 accommodated in the room 101 includes a circuit board 110 and a switch component 111 mounted thereon.

The input pin set 12 and output pin set 13 separately electrically connect the switch module 11. In more detail, the input pin set 12 and output pin set 13 separately electrically connect the switch component 111 of the switch module 11. As shown in FIG. 3 the switch component 111 electrically connects between the input pin set 12 and the output pin set 13. In the shown embodiment, the switch component 111 is a relay, which can be turned on or off by external electricity. For example, the switch component 111 may be of an electronic type or an electromagnetic type. The connection between the input pin set 12 and the output pin set 13 may be controlled by the switch component 111. The input pin set 12 and the output pin set 13 can be electrically connected when the switch component 111 is closed, and the input pin set 12 and the output pin set 13 can be electrically disconnected when the switch component 111 is opened.

Figure 7:
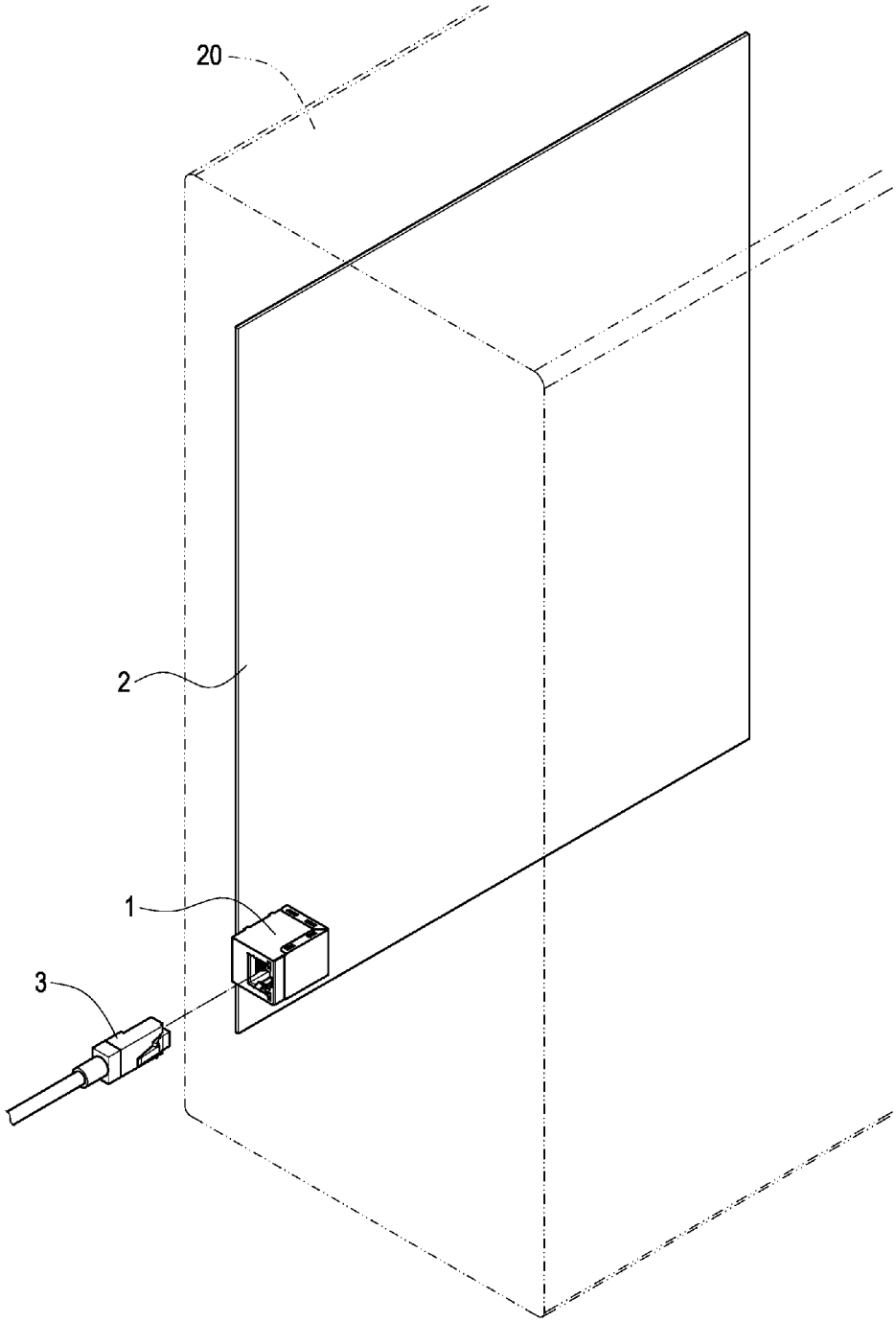
FIG. 7 is a schematic view illustrating the connection of the invention.

The input pin set 12 is accommodated in the room 101. In more detail, the input pin set 12 extends from the room 101 to the through trough 102 for electrically connecting an external network cord 3 (as shown in FIG. 7). The output pin set 13 is accommodated in the room 101 and extends from the circuit board 110 downwards for electrically connecting a motherboard 2 of a computer host 20 (as shown in FIG. 7). As a result, the computer host 20 can be connected to the internet via the network connector 1 and network cord 3 when the input pin set 12 is electrically connected to the output pin set 13 by closing of the switch component 111.

As shown in FIGS. 1 and 2, the through trough 102 accommodates a network plug such as an RJ-45 plug. The input pin set 12 and output pin set 13 are used for transmitting network signals.

As abovementioned, the switch component 111 is controlled to turn on or off by external electricity. The external electricity may be provided by various ways. For example, triggering by wireless air waves or power over ethernet (the PoE) is available.

A plurality of lighting elements 15 are disposed in the room 101. Each of the lighting elements 15 is composed of a luminant 151 and two pins 152 electrically connecting the circuit board 110. The lighting elements 15 extend towards the through trough 102 and protrude from the metal case 14. The isolated body 10 is further provided with a back cover 103 for cloaking the components in the room 101.

Preferably, the switch module 11 may further include a protector mounted on the circuit board 101, by which the network connector 1 can be prevented from damaging of surge. The protector will be further described below.

Figure 4:
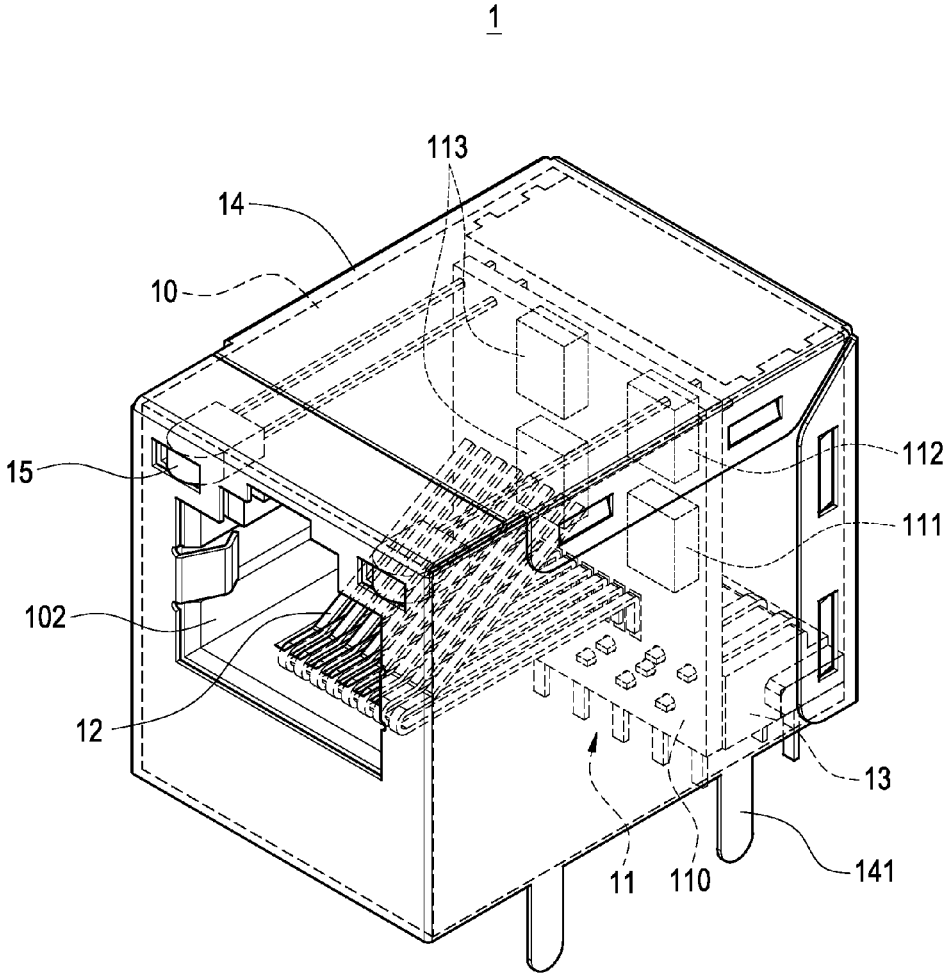
FIG. 4 is a perspective view of another preferred embodiment of the invention.
Figure 5:
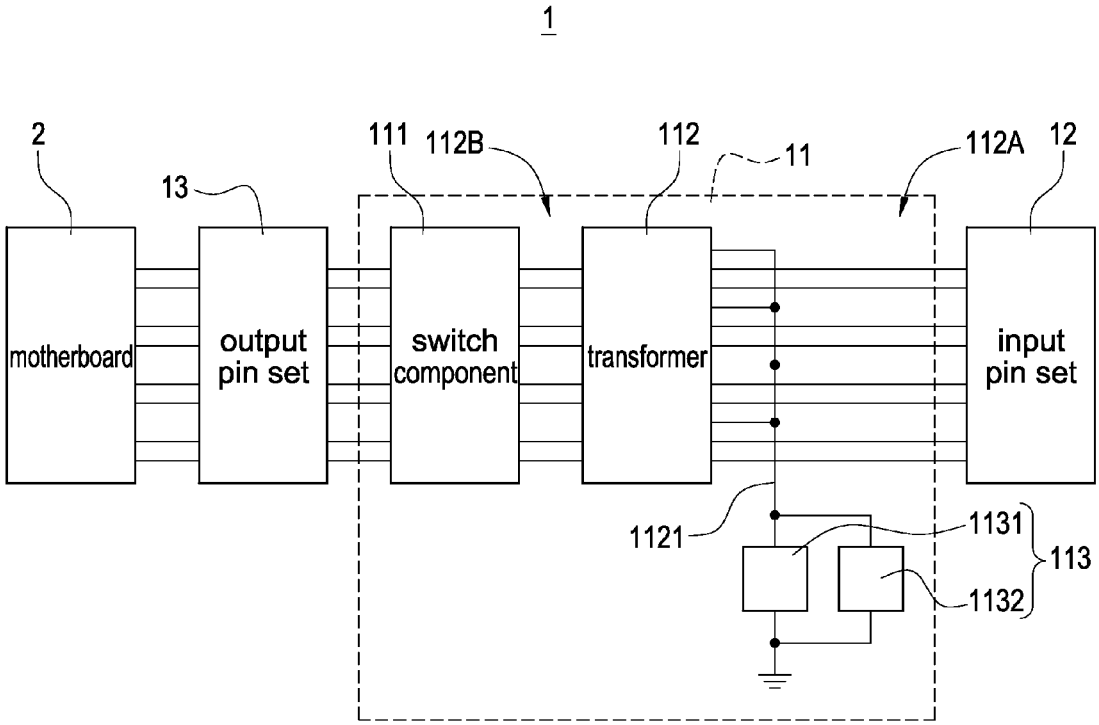
FIG. 5 is a block diagram of the preferred embodiment shown in FIG. 4.

Please refer to FIGS. 4 and 5, which show another preferred embodiment of the invention. The switch module 11 further includes a transformer 112 electrically connecting between the input pin set 12 and the switch component 111 for providing a protective function. The transformer 112 may be an isolation transformer having a primary winding 112A and a secondary winding 112B. The primary winding 112A and the secondary winding 112B electrically connect the input pin set 12 and the switch component 111, respectively.

As abovementioned, the switch module 11 may further be provided with a protector 113. The primary winding 112A of the transformer 112 has an intermediate tap 1121. The protector 113 electrically connects the intermediate tap 1121 and the metal case 14. The protector 113 may form a grounding effect by a ground pin 141 (as shown in FIG. 1) on the bottom of the metal case 14.

The protector 113 includes a gas discharge tube (GDT) 1131 and a surge absorber 1132, which are connected in parallel. The surge absorber 1132 may be a transient voltage suppressor (TVS) or a capacitor. The transformer 112, the GDT 1131 and the surge absorber 1132 may be implemented by an integrated circuit.

Figure 6:
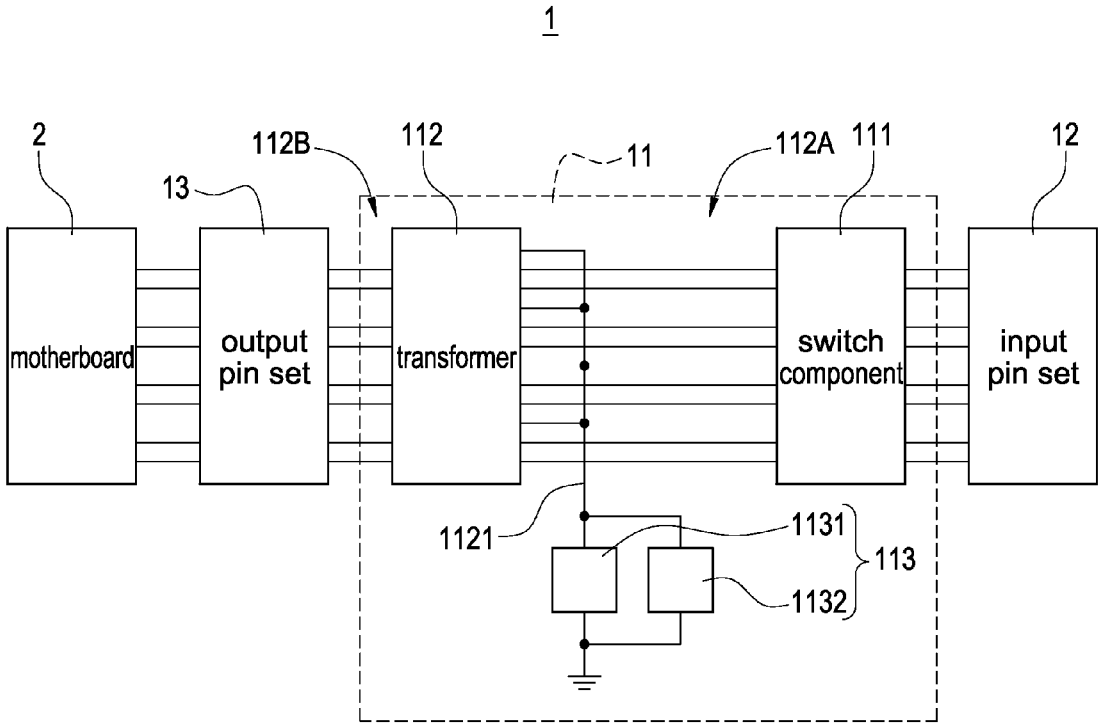
FIG. 6 is a block diagram of still another preferred embodiment of the invention.

FIG. 6 shows a block diagram of a still another embodiment of the invention. In this embodiment, the transformer 112 and the protector 113 are electrically connected between the switch component 111 and the output pin set 13. The primary winding 112A and the secondary winding 112B electrically connect the switch component 111 and the output pin set 13, respectively. The protector 113 electrically connects the intermediate tap 1121 and the metal case 14 (as shown in FIG. 1) for protection.

Finally referring to FIG. 7, the network connector 1 is connected on the motherboard 2 via the output pin set 13 and is electrically connected to the network cord 3 via the input pin set 12.

An administrator may operate an external device (e.g. another computer host) to transmit electricity to the network connector 1 on the motherboard 2. When the switch component 111 is turned on by the electricity from the external device, the input pin set 12 makes an electric connection with the output pin set 13 and then the motherboard 2 of the computer host 20 can connect to the internet via the network connector 1 and the network cord 3. Contrarily, when the switch component 111 is turned off, the input pin set 12 disconnects with the output pin set 13 and the motherboard 2 of the computer host 20 cannot connect to the internet.

If the computer host 20 has connected to the internet, the administrator can monitor the status of network connection of the computer host 20. However, the external device uses electricity to control the network connector 1 instead of a command via the internet. Thus whether the computer host 20 connects or disconnects to the internet, the administrator can control the network connector 1 to turn on or off.

While the forgoing is directed to preferred embodiments of the present invention, other and further embodiments of the invention may be devised without departing from the basic scope thereof. As such, the appropriate scope of the invention is to be determined according to the claims.

What is claimed is:

1. A network connector for being used on a motherboard, comprising:

an isolated body having a room therein and a through trough communicating therewith;

a switch module disposed in the room, having a circuit board and a switch component mounted thereon;

an input pin set disposed in the room, electrically connecting the switch component and extending into the through trough;

an output pin set disposed in the room, electrically connecting the switch component and the motherboard; and a metal case covering the isolated body;

wherein the switch component electrically connects between the input pin set and the output pin set, the switch component is controlled by an external electricity to open or close an electric connection between the input pin set and the output pin set.

2. The network connector of claim 1, wherein the through trough is for accommodating an RJ-45 plug, and the input pin set and the output pin set are for transmitting RJ-45 signals.

3. The network connector of claim 1, wherein the switch component is a relay.

4. The network connector of claim 3, wherein the relay is of an electromagnetic type.

5. The network connector of claim 3, wherein the relay is of an electronic type.

6. The network connector of claim 3, wherein the switch module further comprises a transformer having a primary winding and a secondary winding, and the primary winding and the secondary winding electrically connect the input pin set and the switch component, respectively.

7. The network connector of claim 6, wherein the transformer is an isolation transformer.

8. The network connector of claim 6, wherein the primary winding has an intermediate tap, and the switch module further comprises a protector electrically connecting the intermediate tap and the metal case.

9. The network connector of claim 8, wherein the protector further comprises a gas discharge tube (GDT) and a surge absorber, which electrically connect in parallel.

10. The network connector of claim 9, wherein the surge absorber is a capacitor or a transient voltage suppressor (TVS).

11. The network connector of claim 3, wherein the switch module further comprises a transformer having a primary winding and a secondary winding, and the primary winding and the secondary winding electrically connect the switch component and the output pin set, respectively.

12. The network connector of claim 11, wherein the transformer is an isolation transformer.

13. The network connector of claim 11, wherein the primary winding has an intermediate tap, and the switch module further comprises a protector electrically connecting the intermediate tap and the metal case.

14. The network connector of claim 13, wherein the protector further comprises a gas discharge tube (GDT) and a surge absorber, which electrically connect in parallel.

15. The network connector of claim 14, wherein the surge absorber is a capacitor or a transient voltage suppressor (TVS).

* * * * *